US007303216B2

(12) United States Patent
Bella et al.

(10) Patent No.: US 7,303,216 B2
(45) Date of Patent: Dec. 4, 2007

(54) LATCH ASSEMBLY

(75) Inventors: Joseph J. Bella, Plainfield, IL (US); Steven L. Bivens, Kankakee, IL (US); Paul F. Donovan, Brodhead, WI (US)

(73) Assignee: Illinois Tool Works Inc., Glenview, IL (US)

( * ) Notice: Subject to any disclaimer, the term of this patent is extended or adjusted under 35 U.S.C. 154(b) by 14 days.

(21) Appl. No.: 11/228,675

(22) Filed: Sep. 16, 2005

(65) Prior Publication Data

US 2006/0186677 A1 Aug. 24, 2006

Related U.S. Application Data

(60) Provisional application No. 60/655,166, filed on Feb. 22, 2005.

(51) Int. Cl.
*E05C 19/00* (2006.01)
*E05B 63/20* (2006.01)

(52) U.S. Cl. ..... 292/303; 292/332; 292/333; 292/DIG. 4; 292/DIG. 37

(58) Field of Classification Search ..... 292/300, 292/303, 288, 341.15, 341.18, DIG. 4, DIG. 37, 292/DIG. 38, DIG. 53, 333, DIG. 54, 332, 292/335
See application file for complete search history.

(56) References Cited

U.S. PATENT DOCUMENTS

| | | | | |
|---|---|---|---|---|
| 4,662,664 | A * | 5/1987 | Wendt et al. | 292/19 |
| 4,901,475 | A * | 2/1990 | Simpson | 49/175 |
| 5,401,067 | A * | 3/1995 | Kurosaki et al. | 292/63 |
| 5,419,617 | A * | 5/1995 | Schultz | 297/411.27 |
| 5,775,748 | A * | 7/1998 | Kurachi | 292/341.15 |
| 5,845,954 | A * | 12/1998 | DePue | 296/37.12 |
| 6,056,333 | A * | 5/2000 | Wach | 292/145 |
| 6,220,778 | B1 * | 4/2001 | Suchanek et al. | 403/327 |
| 6,450,468 | B1 * | 9/2002 | Hamamoto | 248/311.2 |
| 6,669,248 | B2 * | 12/2003 | Shirase | 292/300 |
| 6,869,114 | B2 * | 3/2005 | Ueki | 292/341.17 |
| 6,986,535 | B2 * | 1/2006 | Kawamoto et al. | 292/341.15 |
| 2004/0119297 | A1 * | 6/2004 | Bella et al. | 292/300 |

* cited by examiner

*Primary Examiner*—Carlos Lugo
(74) *Attorney, Agent, or Firm*—Mark W. Croll; Paul F. Donovan

(57) ABSTRACT

A latch assembly includes a latch and a casing having a base integrally formed with outer walls, wherein a latch chamber is defined by the base and the outer walls. The casing securely retains the latch within the latch chamber and allows limited movement of the latch within the latch chamber during an impact. Thus, the latch may move within a storage bin door upon impact, thereby preventing unlatching.

11 Claims, 5 Drawing Sheets

LATCH ASSEMBLY

RELATED APPLICATIONS

This application relates to and claims priority benefits from U.S. Provisional Patent Application 60/655,166 entitled "Impact Latch," filed Feb. 22, 2005, which is incorporated by reference herein in its entirety.

FIELD OF THE INVENTION

Embodiments of the present invention generally relate to latching devices and, more particularly, to latch assemblies used in automobile applications, such as, for example, glove boxes, sunglass bins, cup holders, and the like.

BACKGROUND OF THE INVENTION

Upon impact, structures using conventional latch assemblies, such as vehicle storage bins, or glove compartments, may be susceptible to unlatching. For example, the impact of an automobile accident may force the storage bin open. As the storage bin opens, items that were stored within the storage bin may be ejected into the vehicle cabin. The ejected items become moving projectiles that may ultimately cause harm to the occupants of the vehicle, and/or damage the interior of the vehicle.

Thus, a need exists for a latch assembly that remains in a latched position even when unintended external forces are exerted upon it. Further, a need exists for a latch assembly that ensures that a corresponding structure, such as a storage bin door, remains closed during an impact, such as an automobile accident.

SUMMARY OF THE INVENTION

Embodiments of the present invention provide a latch assembly including a slider, latch, and a casing. The slider includes outwardly-extending bosses. The latch is secured to the slider. For example, the latch may be snapably secured to the slider.

The casing includes a main body having a base integrally formed with first, second, and third walls defining a latch chamber therebetween. The first and second walls have slots and boss-retaining snaps disposed within the slots. The slots receive the bosses. The casing receives and retains the slider through the boss-retaining snaps allowing the bosses to pass in a first direction, such as a longitudinal direction. The boss-retaining snaps block movement of the bosses in an opposite first direction, that is, the direction that is opposite that of the first direction.

The casing may also include at least one spring member, such as a spring arm, extending into the latch chamber from the third wall. The spring member exerts a force into the slider that acts to bias the bosses against the boss-retaining snaps.

The casing may also include at least one stop member extending into the latch chamber from at least one of the first and second walls. The stop member is configured to limit movement of the latch in a second direction, such as a lateral direction.

Figure 1:
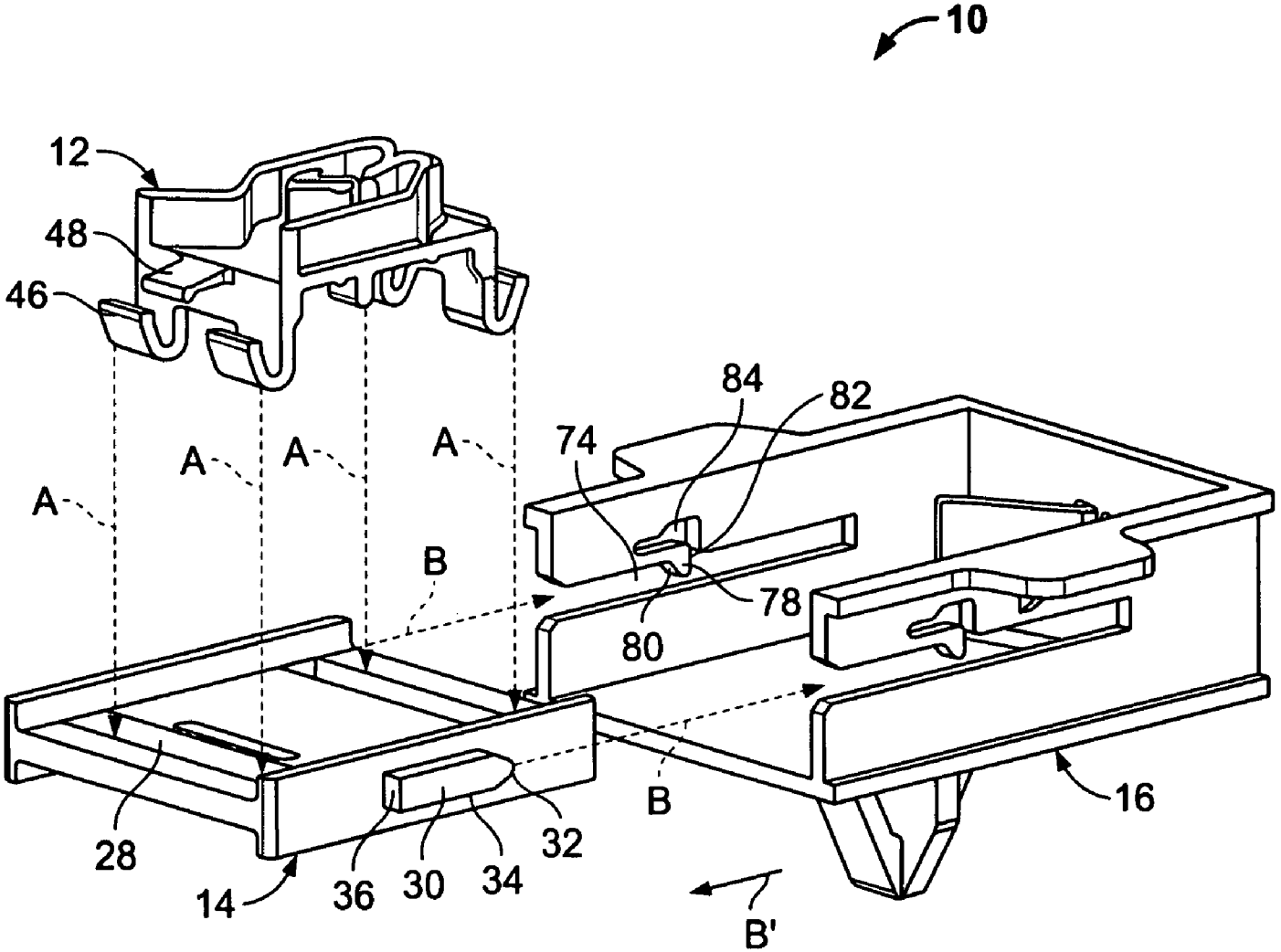
FIG. 1 illustrates a top isometric exploded view of a latch assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates a top isometric exploded view of a latch assembly 10 according to an embodiment of the present invention. The latch assembly 10 may be formed of various metals and/or plastics. The latch assembly 10 includes a latch 12 that is snapably, latchably, or otherwise secured to a slider 14, which is in turn securely retained by a casing 16. The casing 16 is configured to be secured to a relatively stationary structure, such as an automobile dashboard. Alternatively, the casing 16 may be integrally formed with the stationary structure. Also, alternatively, the latch 12 and the slider 14 may be integrally formed together as a single unit.

In order to secure the latch 12 to the slider 14, the latch 12 is urged into the slider 14 in the direction of arrows A until it snapably engages the slider 14. Once the latch 12 is secured to the slider 14, the slider 14 is slid into the casing 16 in the direction of arrows B. Optionally, the slider 14 may be slid into a retained position within the casing 16 before the latch 12 is secured to the slider 14.

Figure 2:
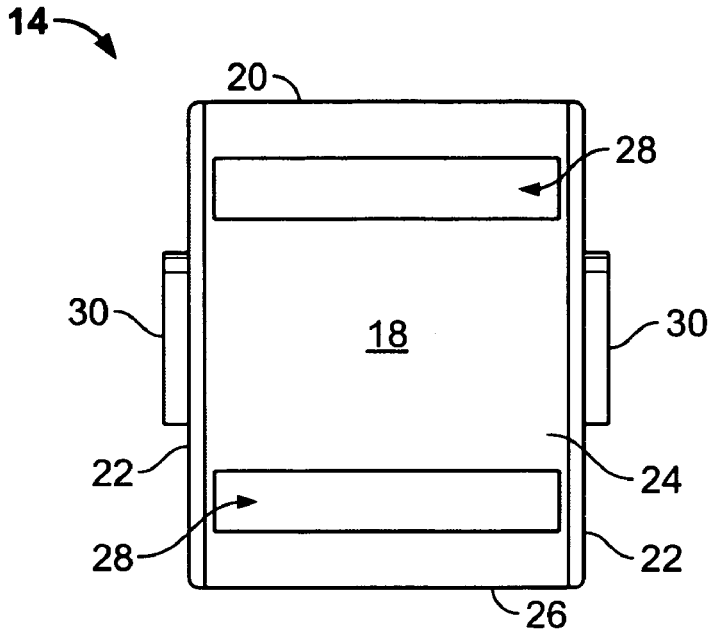
FIG. 2 illustrates a top plan view of a slider according to an embodiment of the present invention.

FIG. 2 illustrates a top plan view of the slider 14. The slider 14 includes a main body 18 having a front wall 20 integrally formed with lateral walls 22 and a base 24, which are in turn integrally formed with a rear wall 26. Latch-retaining slots 28 are formed through the base 24 proximate the front and rear walls 20 and 26. The latch-retaining slots 28 are configured to securely retain reciprocal structures of the latch 12 (shown in FIG. 1). Securing bosses 30 outwardly extend from the lateral walls 22. The securing bosses 30 are configured to be slidably retained by reciprocal slots of the casing 16 (shown in FIG. 1).

Figure 3:
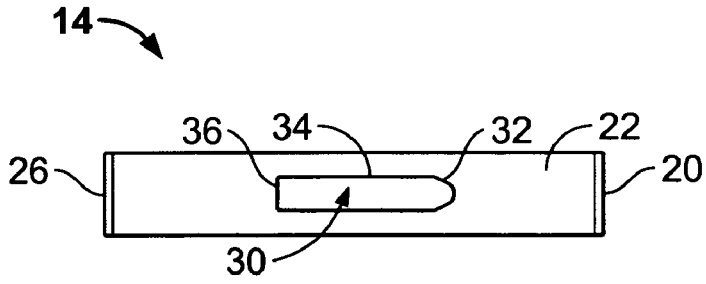
FIG. 3 illustrates a side view of a slider according to an embodiment of the present invention.

FIG. 3 illustrates a side view of the slider 14. As shown in FIG. 3, each securing boss 30 includes front rounded tip 32 integrally connected to an extending portion 34 that terminates at a rear edge 36. The rear edge 36 may form a right angle with the extending portion 34 and may be parallel with the planes of the front and rear walls 20 and 26.

Figure 5:
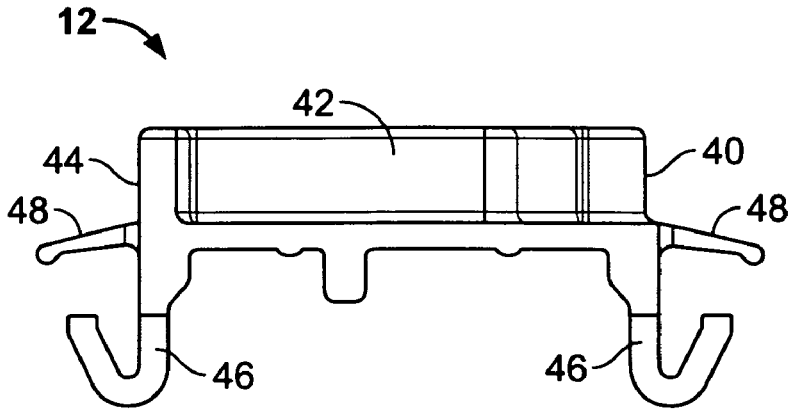
FIG. 5 illustrates a side view of a latch according to an embodiment of the present invention.
Figure 4:
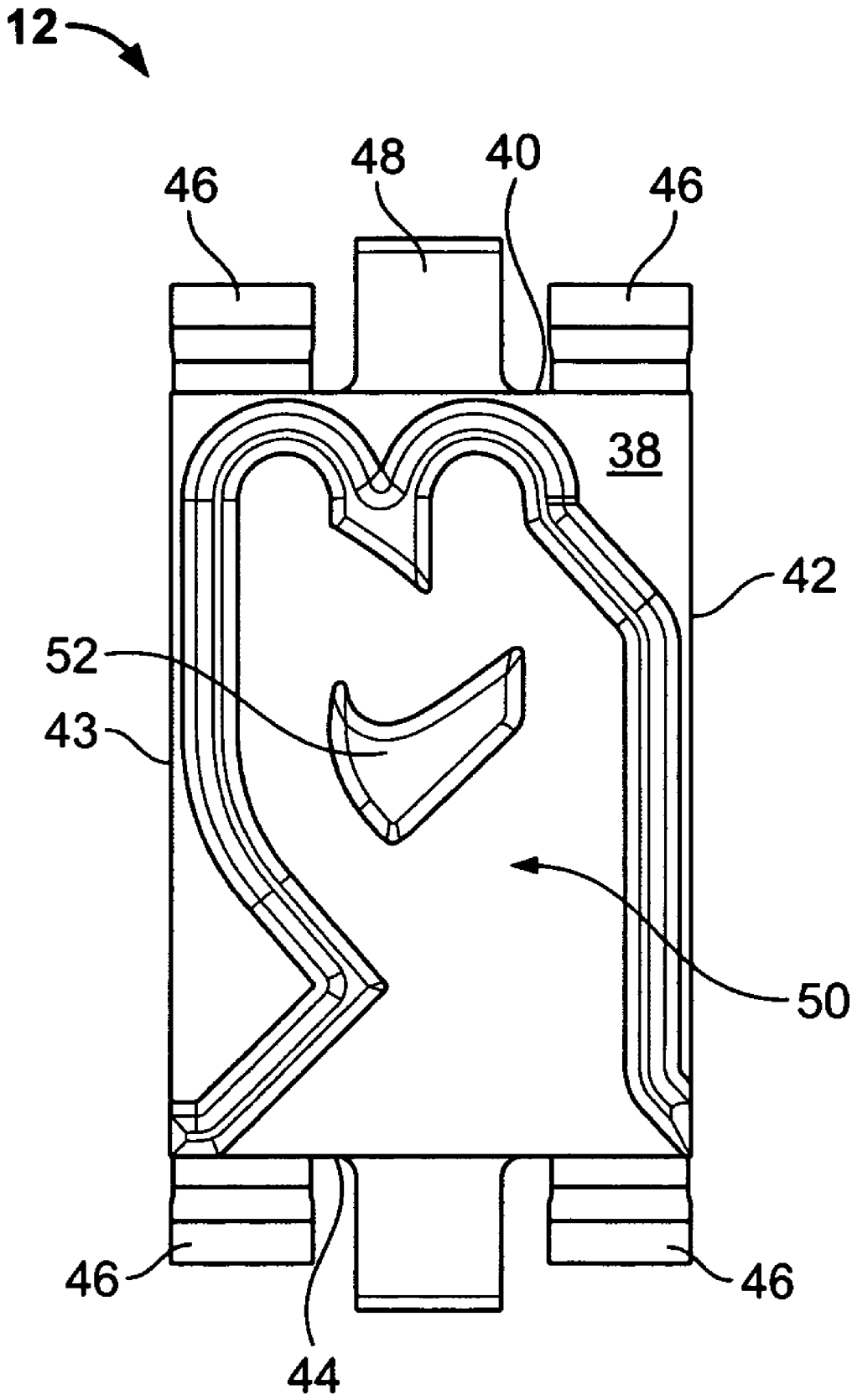
FIG. 4 illustrates a top plan view of a latch according to an embodiment of the present invention.

FIGS. 4 and 5 illustrate top and side views, respectively, of the latch 12. Referring to FIGS. 4 and 5, the latch 12 includes a generally rectangular planar base 38 integrally formed with a front wall 40, lateral walls 42 and 43, and a rear wall 44. Slider engagement prongs 46 extend downwardly from the base 38 proximate the front and rear walls 40 and 44. The slider engagement prongs 46 are configured to be snapably retained by the latch-retaining slots 28 shown, for example, in FIG. 2. Stabilizing tabs 48 extend outwardly from the front and rear walls 40 and 44 and are configured to engage portions of the slider 14 (shown in FIGS. 1-3).

Referring to FIGS. 1-5, when the latch 12 is urged into the slider 14 in the direction of arrows A, the slider engagement prongs 46 are snapably retained by the latch-retaining slots 28, while the stabilizing tabs 48 overlay end portions of the slider 14. Thus, the latch 12 is securely retained by the slider 14. As mentioned above, instead of separate and distinct components, the latch 12 and the slider 14 may be integrally formed as a single unit.

Referring again to FIG. 4, the latch 12 includes a camming chamber 50 having a camming island 52 that is generally centrally positioned within the camming chamber 50. The latch 12 is designed to latch to a pin (not shown), which is typically secured to a relatively movable structure, such as the door of a storage bin, by way of the pin cooperating with the camming chamber 50. The details of the camming chamber 50, and the latching operation are described in U.S. Pat. No. 6,056,333, entitled "Floating Latch Mechanism," issued May 2, 2000, which is hereby incorporated by reference in its entirety.

Figure 6:
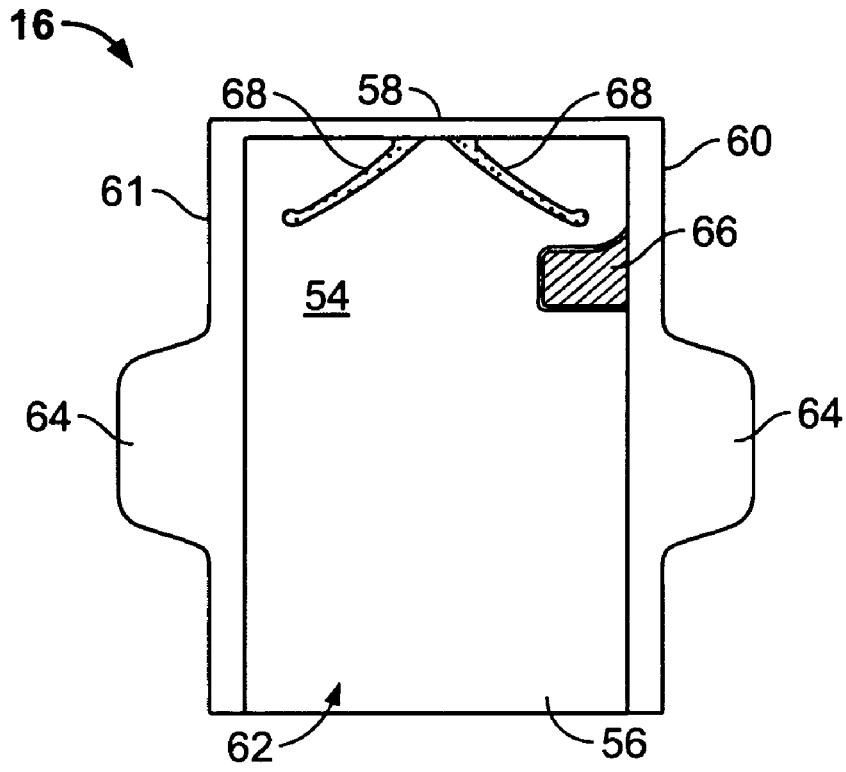
FIG. 6 illustrates a top plan view of a casing according to an embodiment of the present invention.

FIG. 6 illustrates a top plan view of the casing 16. The casing 16 includes a main body 54 having a base 56 integrally formed with a front wall 58 and lateral walls 60 and 61. The base 56, front wall 58 and lateral walls 60, 61 define a latch chamber 62. Assembly push pads 64 extend outwardly from the lateral walls 60 and are configured to assist in securing the casing 16 to a relatively stationary structure, such as an automobile dashboard. Resilient spring arms 68 extend from the front wall 58 into the latch chamber 62. While spring arms 68 are shown, various other biasing members may be used, such as coiled springs, rubber pads, and the like. A stop wall, block, protuberance, barb, spur, or other such member 66 extends inwardly from an upper portion of the lateral wall 60 within the latch chamber 62 proximate the front wall 58. The stop member 66 is configured to allow the slider 14 (shown in FIGS. 1-3) to pass underneath. Alternatively, the casing 16 may not include the stop member 66. Also, alternatively, an additional stop member may extend inwardly from the lateral wall 61.

Figure 7:
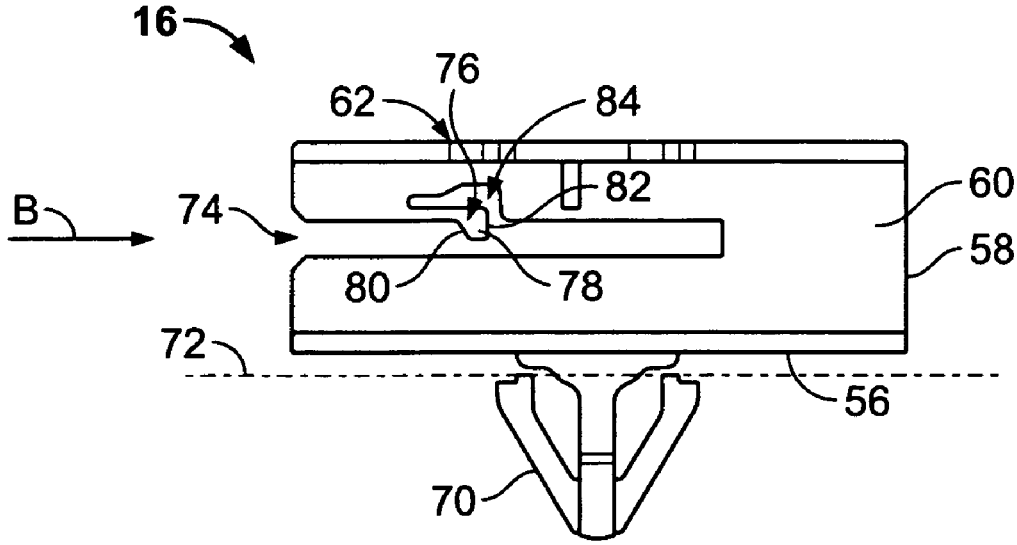
FIG. 7 illustrates a side view of a casing according to an embodiment of the present invention.

FIG. 7 illustrates a side view of the casing 16. A fastener 70 extends from the base 56 away from the latch chamber 62. The fastener 70 is configured to secure the casing 16 to a relatively stationary structure 72 (which is represented by a phantom line), such as an automobile dashboard. The fastener 70 may be a snap member, screw, bolt, latch, or any other such device that cooperates with a reciprocal structure on the structure 72. Alternatively, as mentioned above, the casing 16 may be formed as part of the structure 72.

Slots 74 are formed through each lateral wall 60 and 61 (only lateral wall 60 is shown in FIG. 7). Boss-retaining snaps 76 are disposed within the slots 74. Each boss-retaining snap 76 includes a protuberance 78 having a slanted edge 80 integrally formed with a stop edge 82. The stop edge 82 may be parallel with the plane of the front wall 58. The boss-retaining snap 76 extends between the boss-retaining slot 74 and a clearance gap 84. As shown in FIG. 7, the protuberance 76 also extends into the boss-retaining slot 74.

Referring to FIGS. 1 and 7, in order to secure the slider 14 into the casing 16, the slider 14 is slid into the casing 16 in the direction of arrows B such that the securing bosses 30 are slidably received within the slots 74. As the slider 14 is urged into the casing 16, the front rounded tips 32 of the securing bosses 30 engage the slanted edges 80 of the protuberances 78. The rounded tips 32 slide past the slanted edges 80 as the slider 14 is continually urged into the casing 14, thereby flexing the protuberances toward the clearance gap 84. Continued urging of the slider 14 into the casing 16 maintains the protuberances 78 in a flexed position toward the clearance gaps 84 as the extending portions 34 of the bosses slide past the protuberances 78.

Once the bosses 30 are slid past the protuberances 78, the boss-retaining snaps 76 flex back down toward the slots 74. The slider 14 is then restricted from moving out of the casing 16 in the direction of B' due to the stop edges 82 of the boss-retaining snaps 76 engaging the rear edges 36 of the bosses 30. That is, as the slider 14 slides back in the direction of B', the stop edges 82 abut the straight rear edges 36 of the bosses 30, thereby trapping the slider 14, and therefore the latch 12, within the casing 16. Optionally, the slots 74 may be sized and configured to restrict any movement of the slider 14 in the direction of B'.

Figure 8:
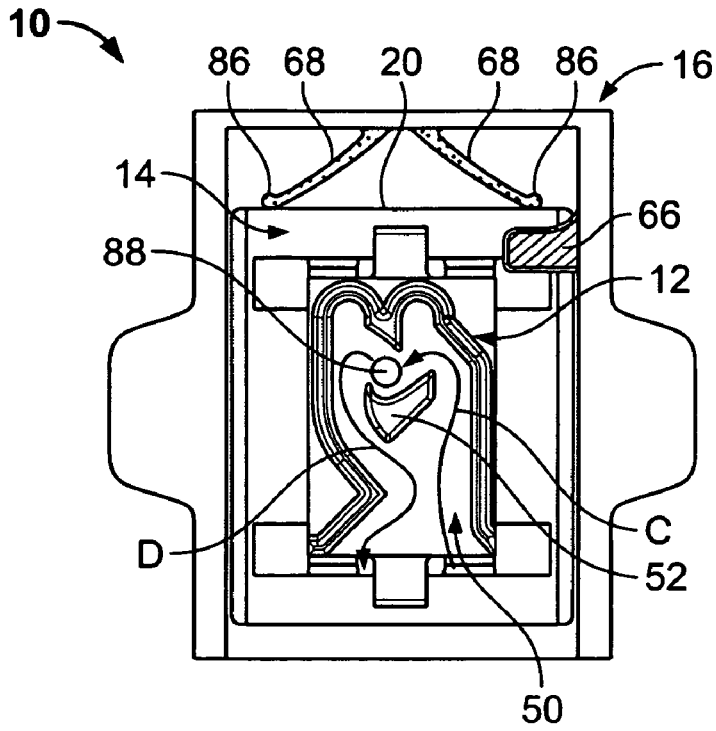
FIG. 8 illustrates a top plan view of a latch assembly in a normal operating position according to an embodiment of the present invention.

FIG. 8 illustrates a top plan view of the latch assembly 10 in a normal operating position. The latch 12 is secured within the slider 14, which is in turn retained within the casing 16. The slider 14 is retained underneath the stop member 66, which is located at approximately the same level as the lateral walls 42, and 43 of the latch 12. Distal ends 86 of the spring arms 68 of the casing 16 abut the front wall 20 of the slider 14 and bias the bosses 30 (shown, e.g., in FIGS. 1-3) of the slider 14 against the stop edges 82 (shown, e.g., in FIGS. 1 and 7) of the boss-retaining snaps 76, thereby longitudinally stabilizing the slider 14 and the latch 12 within the casing.

A pin 88, which is typically secured to a relatively movable structure, such as the door of a storage bin, is positioned in a latched position within the camming chamber 50 above the camming island 52. The pin 88 is configured to cooperate with the latch 12 in order to latch and unlatch the door between closed and open positions.

The pin 88 is moved into a secure latched position as shown generally by arrow C, and as described in U.S. Pat. No. 6,056,333. In order to unlatch the door of the storage bin, the pin is traverses the cam path in the general direction of arrow D.

Figure 9:
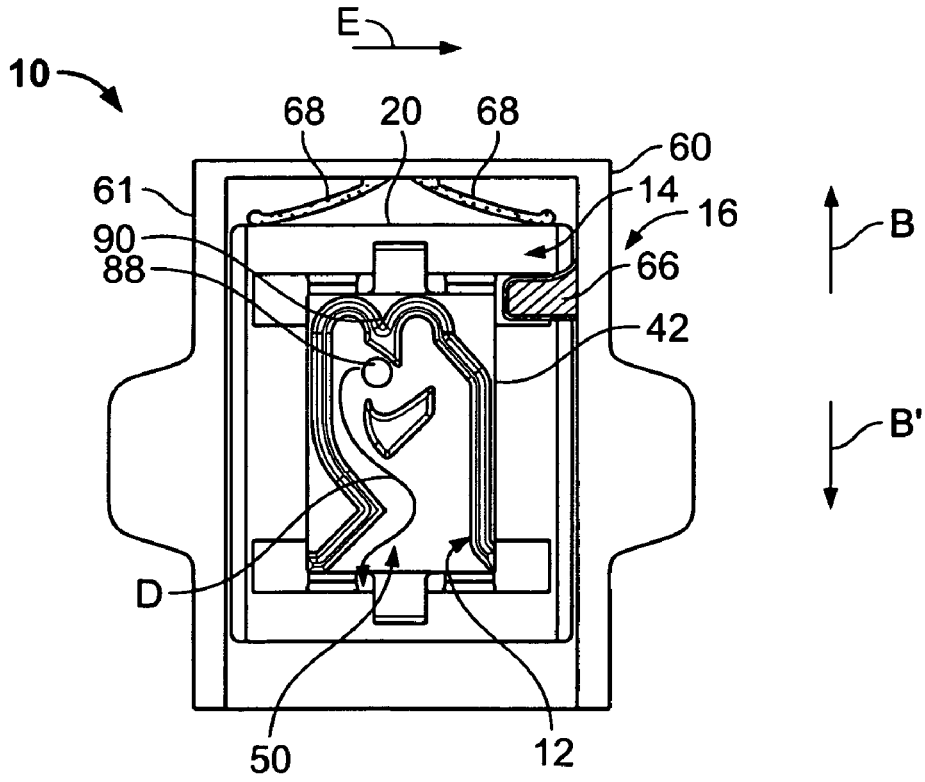
FIG. 9 illustrates a top plan view of a latch assembly in an impact position according to an embodiment of the present invention.

FIG. 9 illustrates a top plan view of the latch assembly 10 in an impact position. As discussed above with respect to FIGS. 1 and 7, movement of the slider 14 and the latch 12 within the casing 16 in the direction of arrow B' is limited by the bosses 30 (shown, e.g., in FIGS. 1 and 3) being trapped within the slots 74 (shown, e.g., in FIGS. 1 and 7) by the boss-retaining snaps 76 (shown, e.g., in FIGS. 1 and 7). Upon impact, the slider 14 and latch 12 may move in the direction of arrow B. As the slider 14 moves in the direction of arrow B, the front wall 20 exerts a force into the spring arms 68, thereby compressing the spring arms 68 and flexing them apart. As the spring arms 68 flex, the spring arms 68 exert an equal, but opposite, force into the front wall 20 of the slider 14 in the direction of arrow B'. The force exerted by the spring arms 68 into the front wall 20 of the slider 14 acts to allow limited movement of the slider 14, and therefore the latch 12, in the direction of arrow B. That is, as the spring arms 68 flex, the spring arms 68 allow the slider 14 to move forward in the direction of arrow B in the slots 28 (shown, e.g., in FIG. 2). Thus, as the bin door is biased forward during impact, the slider 14 and the latch 12 are allowed to move with the door. After the impact, the spring arms 68 return to their normal positions, as shown in FIG. 8, thereby moving the slider 14 in the direction of arrow B' until the bosses 30 (shown, e.g., in FIGS. 1-3) of the slider 14 are biased into the boss-retaining snaps 76 (shown, e.g., in FIGS. 1 and 7). Thus, the pin 88 is maintained at a relatively stable longitudinal position in the camming chamber 50 with respect to the latch 12 before, during, and after impact.

The camming chamber also includes a front slanted wall 90 that may further limit movement of the pin 88 within the camming chamber 50. The slanted wall 90 may be configured to prevent the pin 88 from sliding over it in the direction of arrow D upon impact. Additionally, as the slider 14 moves in the direction of arrow B underneath the stop member 66, the stop member 66 abuts the lateral wall 42 of the latch 12, thereby preventing the latch assembly from shifting in the direction of arrow E. That is, the pin 88 is prevented from biasing the latch 12 in the direction of arrow E because of the abutting relationship between the stop member 66 and the lateral wall 42. Thus, upon impact, the pin 88 is prevented from moving in the unlatching direction shown generally by arrow D. While only one stop member 66 is shown, more than one stop member 66 may be utilized so long as the latch 12 is prevented from laterally moving in the direction that is normally associated with opening the door. For example, a stop member may extend toward the slider 14 from the wall 61 of the casing 16.

While the terms front and rear are used to describe various walls of the components of the system, it is understood that such terms are used with respect to securing orientation. For example, the front wall 20 of the slider 14 is slid into the casing 16 first. The orientations, however, may be inverted, such that the front wall 20 would be the rear wall, etc. For example, in FIGS. 8 and 9, the top portion of the latch assembly 10 may, instead, be the bottom portion of the latch assembly 10.

Embodiments of the present invention provide a latch that may move within a storage bin door, thereby preventing unlatching upon impact. Embodiments of the present invention provide a latch assembly that remains in a latched position even when unintended external forces are exerted upon it. Further, embodiments of the present invention provide a latch assembly that ensures that a corresponding structure, such as a storage bin door, remains closed during an impact, such as an automobile accident.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A latch assembly positioned on a stationary structure, said latch assembly comprising:

a latch;

a casing comprising a base integrally formed with outer walls, wherein a latch chamber is defined by said base and said outer walls, said casing securely retaining said latch within said latch chamber and allowing limited movement of said latch within said latch chamber during an impact, said casing having a fastener extending from said base and away from said latch chamber, wherein said fastener is configured to secure said casing to the stationary structure; and a slider having an outwardly-extending boss, wherein said latch is secured to said slider, wherein said casing further comprises a slot formed within one of said outer walls and a boss-retaining snap disposed within said slot, said slot receiving said boss, said boss-retaining snap allowing said boss to pass in a first direction and blocking movement of said boss in an opposite second direction.

2. The latch assembly of claim 1, wherein said boss-retaining snap comprises a protuberance having a slanted edge joined to a straight edge.

3. The latch assembly of claim 2, wherein said boss comprises a rounded tip and a rear edge, said rounded tip sliding past said protuberance in the first direction, and said rear edge abutting against said straight edge in the opposite second direction.

4. The latch assembly of claim 1, wherein said latch is integrally formed with said slider.

5. The latch assembly of claim 1, wherein said casing further comprises at least one spring member extending into said latch chamber from at least one of said outer walls, said at least one spring member exerting a biasing force toward said latch, wherein said at least one spring member allows limited movement of said latch in the first direction.

6. The latch assembly of claim 1, wherein said casing further comprises at least one stop member extending into said latch chamber from at least one of said outer walls, said at least one stop member configured to limit movement of said latch in a third direction.

7. The latch assembly of claim 1, wherein said casing is integrally formed with a stationary structure.

8. The latch assembly of claim 1, wherein said latch comprises a camming chamber.

9. A latch assembly comprising:

a slider comprising outwardly-extending bosses;

a latch secured to said slider; and a casing comprising:

(i) a main body having a base integrally formed with first, second, and third walls defining a latch chamber therebetween, said first and second walls having slots and boss-retaining snaps disposed within said slots, said slow receiving said bosses, said casing receiving and retaining said slider through said boss-retaining snaps allowing said bosses to pass in a first direction, and said boss-retaining snaps blocking movement of said bosses in an opposite second direction;

(ii) spring arms extending into said latch chamber from said third wall, said spring arms exerting a force into said slider causing said bosses to bias against said boss-retaining snaps, wherein said slider compresses said spring arms during an impact, said compressed spring arms allowing limited movement of said slider in the first direction during the impact; and (iii) at least one stop member extending into said latch chamber from at least one of said first and second walls, said at least one stop member configured to allow said slider to pass underneath and limit movement of said latch in a third direction that is generally normal to said first and second direction.

10. The latch assembly of claim 9, wherein said latch is integrally formed with said slider.

11. The latch assembly of claim 9, wherein said casing is integrally formed with a dashboard of a vehicle.

* * * * *